US006676771B2

(12) United States Patent
Takashima et al.

(10) Patent No.: US 6,676,771 B2
(45) Date of Patent: Jan. 13, 2004

(54) METHOD OF MANUFACTURING GRAIN-ORIENTED ELECTRICAL STEEL SHEET

(75) Inventors: Minoru Takashima, Kurashiki (JP); Tetsuo Toge, Kurashiki (JP); Yasuyuki Hayakawa, Kurashiki (JP); Mitsumasa Kurosawa, Kurashiki (JP); Michiro Komatsubara, Kurashiki (JP)

(73) Assignee: JFE Steel Corporation (JP)

( * ) Notice: Subject to any disclaimer, the term of this patent is extended or adjusted under 35 U.S.C. 154(b) by 0 days.

(21) Appl. No.: 10/208,907

(22) Filed: Jul. 30, 2002

(65) Prior Publication Data

US 2003/0034092 A1 Feb. 20, 2003

(30) Foreign Application Priority Data

Aug. 2, 2001 (JP) ..... 2001-234948
Aug. 6, 2001 (JP) ..... 2001-237390

(51) Int. Cl.[7] ..... H01F 1/00; H01F 1/04
(52) U.S. Cl. ..... 148/120; 148/111

(58) Field of Search ..... 148/111–113, 120–122

(56) References Cited

U.S. PATENT DOCUMENTS 5,489,342 * 2/1996 Arai et al. ..... 148/111
6,322,635 * 11/2001 Hayakawa et al. ..... 148/111

FOREIGN PATENT DOCUMENTS

JP 3-28320 * 2/1991 ..... 148/112

* cited by examiner

*Primary Examiner*—John Sheehan
(74) *Attorney, Agent, or Firm*—Piper Rudnick LLP

(57) ABSTRACT

Manufacturing a grain-oriented electrical steel sheet, a secondary recrystallization step and a forsterite coating forming step are separated into first batch annealing for developing secondary recrystallization and second batch annealing for forming a forsterite coating, with continuous annealing performed between these two steps of batch annealing, to produce a grain-oriented electrical steel sheet that is superior in both magnetic characteristics and coating characteristics.

14 Claims, No Drawings

METHOD OF MANUFACTURING GRAIN-ORIENTED ELECTRICAL STEEL SHEET

BACKGROUND OF THE INVENTION

1. Field of the Invention

The present invention relates to a method of manufacturing a grain-oriented electrical steel sheet that is very superior in both magnetic characteristics and coating characteristics.

2. Description of the Related Art

Grain-oriented electrical steel sheets are soft magnetic materials used as iron core materials for transformers and generators.

Recently, a demand for reducing energy losses generated in electrical equipment has increased from the viewpoint of energy saving. In grain-oriented electrical steel sheets used as iron core materials, correspondingly, more satisfactory magnetic characteristics have been demanded with a stronger demand than in the past.

A grain-oriented electrical steel sheet has a crystal structure in which the <001> direction, i.e., the axis of easy magnetization, is highly aligned in the rolling direction of a steel sheet. Such a texture is formed with secondary recrystallization, which is performed in finish annealing during the process of manufacturing a grain-oriented electrical steel sheet to grow crystal grains preferentially in the (110)[001] orientation, called the Goss orientation, into a big size. Accordingly, the crystal orientation of secondary recrystallization grains greatly affect the magnetic characteristics.

Also, a glass coating called a forsterite coating is present on the surface of base iron of a grain-oriented electrical steel sheet. The forsterite coating serves not only to ensure insulation between steel sheet layers when grain-oriented electrical steel sheets are laminated to form an iron core, etc., but also to apply a tension to the steel sheet for reducing its iron loss.

Grain-oriented electrical steel sheets are sheared and then subjected to strain releasing annealing at around 800° C. for around 3 hours at a user. Therefore, the forsterite coating is required to endure the strain releasing annealing and not peeled off even when subjected to working, such as bending, after strain releasing annealing. This is called bending peel-off resistance after strain releasing annealing.

Such a grain-oriented electrical steel sheet is generally manufactured through the following steps.

First, a steel slab containing Si of not more than about 4.5 mass % is heated and subjected to hot rolling. After annealing a hot-rolled steel sheet as required, the steel sheet is subjected to cold rolling once, or twice or more with intermediate annealing interposed therebetween to obtain a cold-rolled steel sheet having a final thickness. Then, the steel sheet is subjected to continuous annealing in a humid hydrogen atmosphere to develop primary recrystallization. This is hereinafter referred to as "primary-recrystallization continuous annealing". After applying an annealing separator made primarily of magnesia, the steel sheet is subjected to finishing annealing performed as batch annealing at around 1200° C. for around 5 hours. During the finishing annealing, secondary recrystallization occurs and formation of the forsterite coating progresses.

Related techniques are disclosed in, e.g., U.S. Pat. No. 1,965,559, Japanese Examined Patent Application Publication Nos. 40-15644 and 51-13469, Japanese Unexamined Patent Application Publication Nos.3-122227 and 2001-30201, etc.

From the viewpoint of preventing deterioration of magnetic characteristics with aging, the C content in an electrical steel sheet is preferably kept as low as about 0.005 mass % in the final product. On the other hand, in case that a slab is heated at high temperature to bring an inhibitor component into a solid solution state, C of about 0.01 to 0.1 mass % is preferably present in the slab to suppress grain growth during heating of the slab. Therefore, decarburization annealing is generally performed before finishing annealing in many cases, so that the C content is reduced to a level required for the final product. The conventional decarburization annealing is often performed to serve also as primary recrystallization annealing. Recently, however, a manufacturing method not using an inhibitor component has also been proposed, as will be described later. It is common knowledge that, in such a case, the C content can be reduced even from the initial stage.

In summary, a conventional general process of manufacturing a grain-oriented electrical steel sheet comprises the steps of slab heating—hot rolling—(annealing of hot-rolled steel sheet)—cold rolling—(intermediate annealing—cold rolling)—continuous annealing (primary recrystallization annealing—decarburization annealing)—application of annealing separator—batch annealing (finishing annealing). After the finishing annealing, it is also possible to perform additional steps by applying a treatment solution to form an insulating coating and baking it.

However, the above-described conventional process of manufacturing a grain-oriented electrical steel sheet has a serious difficulty in obtaining both superior magnetic characteristics and superior coating characteristics.

In other words, the problem is that efforts to improve magnetic characteristics deteriorate the coating characteristics, and conversely the efforts to improve coating characteristics deteriorate the magnetic characteristics.

SUMMARY OF THE INVENTION

As stated above, obtaining both superior magnetic characteristics and superior coating characteristics has been very difficult to realize with the conventional manufacturing process, and this has been a limitation in stably manufacturing a grain-oriented electrical steel sheet that is superior in those characteristics, which has been especially demanded by the industry in recent years.

For the purpose of advantageously solving the problems set forth above, it is an object of the present invention to provide a method of manufacturing a grain-oriented electrical steel sheet, which includes a quite novel manufacturing process capable of obtaining both superior magnetic characteristics and superior coating characteristics.

How the present invention has been accomplished is described below in detail.

We have discovered that a difficulty in achieving both superior magnetic characteristics and superior coating characteristics was attributable to the finishing annealing step at a time in which secondary recrystallization was performed and when a forsterite coating was formed at the same time.

In the conventional manufacturing process, secondary recrystallization develops during finishing annealing. The finishing annealing is usually performed in a hydrogen atmosphere at around 1200° C. for around 5 hours. In that process, the gas composition during finishing annealing, the composition and reactivity of the annealing separator, the composition and form of oxides formed on the surface of a steel sheet, etc. greatly affect the crystal orientation of secondary recrystallization grains, i.e., the magnetic characteristics of the steel.

On the other hand, the forsterite coating is also formed during finishing annealing. As with magnetic characteristics, therefore, the gas composition during finishing annealing, the composition and reactivity of the annealing separator, the composition and form of oxides formed on the surface of a steel sheet, etc. are found to greatly affect behaviors in formation of the forsterite coating, i.e., coating characteristics.

However, preferable conditions for the secondary recrystallization and preferable conditions for the formation of the forsterite coating are not easily matched with each other. Even if there are conditions matched with each other, those conditions are satisfied in very narrow ranges. It has been, therefore, very difficult to manufacture a grain-oriented electrical steel sheet that is superior in both magnetic characteristics and coating characteristics with stability from the industrial point of view.

In view of those situations, the inventors have discovered that superior magnetic characteristics and superior coating characteristics can be both obtained by separating finishing annealing, in which the secondary recrystallization and the formation of the forsterite coating were both performed in the past, into (I) annealing (hereinafter referred to as "first batch annealing") for developing the secondary recrystallization and (III) annealing (hereinafter referred to as "second batch annealing" or "finishing annealing") for forming the forsterite coating, and by performing continuous annealing (II) (hereinafter referred to as "continuous annealing after the first batch annealing") between those two steps (I) and (III) of batch annealing.

Further, we have studied conditions for the continuous annealing before and after the first batch annealing, and have clarified the effects of the annealing temperature, the annealing time, the oxidization of an atmosphere, etc. of those continuous annealings upon both the magnetic characteristics and the coating characteristics. Also, we have variously studied the effects of carbon (C)in the steel sheet, which greatly affects behaviors in deformation of the steel sheet during rolling and behaviors in formation of the coating, and have clarified the effects of carbon upon both the magnetic characteristics and the coating characteristics.

More specifically, the present invention resides in a method of manufacturing a grain-oriented electrical steel sheet that is superior in both magnetic characteristics and coating characteristics. The method comprises the steps of preparing a steel slab containing Si, preferably a steel slab containing Si of not more than 4.5 mass % and carbon of 0.01 to 0.1 mass %; rolling the steel slab (preferably with the steps of hot-rolling it to obtain a hot-rolled steel sheet, annealing the hot-rolled steel sheet as required, and performing cold rolling once, or twice or more with intermediate annealing interposed therebetween) to obtain a steel sheet having a final thickness; preferably performing primary-recrystallization continuous annealing to develop primary recrystallization in the sheet; and performing two steps of batch annealing with continuous annealing interposed therebetween, i.e., performing (I) first batch annealing (secondary recrystallization annealing), continuous annealing (II) (continuous annealing after the first batch annealing), and (III) second batch annealing (finishing annealing) successively in that order; and applying an annealing separator to surfaces of the steel sheet before the second batch annealing (III).

The primary-recrystallization continuous annealing is preferably performed under an annealing temperature of not lower than 700° C., but not higher than 1050° C. and an annealing time not shorter than 1 second, but not longer than 20 minutes.

Also, the first batch annealing is preferably performed under an annealing temperature of not lower than 750° C., but not higher than 1250° C. and an annealing time of not shorter than 30 minutes, but not longer than 500 hours.

Further, the continuous annealing after the first batch annealing is preferably performed under an annealing temperature of not lower than 750° C., but not higher than 1100° C. and annealing time of not shorter than 1 second, but not longer than 20 minutes.

In the present invention, preferably, assuming the atmosphere oxygen potential ($P[H_2O]/P[H_2]$) in the primary-recrystallization continuous annealing to be A and the atmosphere oxygen potential ($P[H_2O]/P[H_2]$) in the continuous annealing after the first batch annealing to be B, each step of the continuous annealing before and after the first batch annealing is performed under conditions satisfying:

$$A \leqq 0.6,\ 0.1 \leqq B \leqq 0.7 \text{ and } B-A \geqq 0$$

Also, in the present invention, the carbon content in the steel sheet before the first batch annealing is controlled to be held in the range of not less than 0.003 mass %, but not more than 0.03 mass %.

Further, preferably, the C content in the steel sheet after the second batch annealing is reduced to be not more than 0.005 mass %.

Moreover, preferably, the C content in the steel sheet before the last step of the cold rolling is controlled to be not less than 0.01 mass %.

In addition, preferably, the annealing separator is made of primarily magnesia, and the grain-oriented electrical steel sheet has a forsterite coating.

DESCRIPTION OF THE PREFERRED EMBODIMENTS

The present invention will be described below in detail.

A slab for use in the present invention is manufactured by steel-making—continuous casting (or ingot-making—blooming).

So long as the slab is made of silicon-containing steel, no particular limitations are imposed on a slab composition, and any of conventionally known compositions of grain-oriented electrical steel sheets is suitably used. In practice, however, preferable slab composition ranges are as follows.

Si is an element useful for increasing electrical resistance and reducing an iron loss. Therefore, Si is preferably contained in amount of about 3 mass %. However, if the Si content exceeds 4.5 mass %, cold rolling would be very difficult to carry out. Hence, Si is preferably contained in amount of not more than about 4.5 mass %. As a lower limit, Si is preferably contained in amount of about 1.0 mass % at minimum.

C is an element useful for improving the texture. From this point of view, C is preferably contained in the range of about 0.01 to 0.1 mass %.

Further, to control secondary recrystallization, any of S, Se and N, sulfide forming elements, selenide forming elements (such as Mn and Cu), nitride forming elements (such as Al and B), as well as grain boundary segregation elements (such as Sb, Sn and Bi) can be added which serves as an inhibitor.

Preferable amounts of those inhibitor components, when used, are as follows.

S and Se are elements for developing the inhibitor function in the form of sulfides and Se compounds, and can be added alone or in combination. In either case, each element is preferably contained in the range of 0.001 to 0.03 mass %. The reason is in that if the content is less than 0.001 mass %, the inhibitor function is difficult to develop, and if the content exceeds 0.03 mass %, the element is difficult to solid-solve evenly during the slab heating, and the inhibitor function would be possibly impaired.

N is an element for developing the inhibitor function in the form of nitrides, and is preferably contained in the range of 0.001 to 0.015 mass %. The reason is in that if the content is less than 0.001 mass %, the inhibitor function is difficult to develop sufficiently, and if the content exceeds 0.015 mass %, swelling would possibly occur.

Al and B are elements forming nitrides and developing the inhibitor function. To that end, Al and B are preferably added in amount not less than about 0.003 mass % and about 0.0001 mass %, respectively. However, if the Al content exceeds 0.05 mass %, Al is difficult to solid-solve evenly during the slab heating and dispersion control of an inhibitor is difficult to carry out. Also, if B exceeds about 0.010 mass %, mechanical characteristics of a product sheet, such as a bending characteristic, would be possibly deteriorated. Therefore, the Al content is preferably in the range of about 0.003 to 0.05 mass %, and the B content is preferably in the range of about 0.0001 to 0.010 mass %. Further, the B content is more preferably to be not more than about 0.002 mass %.

Sb, Sn and Bi are elements segregating at the grain boundary and developing the inhibitor function. However, if those elements are added in excessive amount, mechanical characteristics of a product sheet, such as a bending characteristic, would be possibly deteriorated. Therefore, the Sb content is preferably in the range of about 0.001 to 0.2 mass %, the Sn content is preferably in the range of about 0.001 to 0.4 mass %, and the Bi content is preferably in the range of about 0.0005 to 0.05 mass %. Further, the Sb and Sn contents are each more preferably to be not more than about 0.1 mass %.

This invention can utilize techniques capable of effectuating secondary recrystallization with no need of particularly adding any of those inhibitor elements. In those cases, N, S and Se, which are elements developing the inhibitor function, are each preferably limited in the range of not less than 50 ppm. The expression "mass ppm" is similar to "ppm" when it appears in the following description. In this case, Al is preferably present in the range of less than about 100 ppm.

Mn is an element not only forming MnS and MnSe and serving as an inhibitor, but also providing the effect of increasing electrical resistance and the effect of improving hot workability in the manufacturing process. To that end, Mn is preferably contained in amount not less than about 0.03 mass %. However, if the Mn content exceeds about 2.5 mass %, this would possibly induce γ transformation and deteriorate the magnetic characteristics. Therefore, Mn is preferably contained in the range of about 0.03 to 2.5 mass %.

Cu is an element not only forming CuS and CuSe and serving as an inhibitor, but also providing the effect of improving the coating characteristics. To that end, Cu is preferably contained in amount not less than about 0.01 mass %. However, if the Cu content exceeds about 0.5 mass %, the surface properties would be possibly deteriorated. Therefore, Cu is preferably contained in the range of about 0.01 to 0.5 mass %.

In addition to the elements mentioned above, any of Cr, Mo, Nb, V, Ni, P, Ti, etc. may also be contained in total amount of not more than about 1% as incidental elements or impurities.

After heating the slab having the composition adjusted so as to fall in the preferable range for each component, the slab is subjected to hot rolling. The slab heating step is not limited to any particular one, and may be performed at a low temperature of around 1100° C. or a high temperature of around 1400° C.

Then, after annealing a hot-rolled steel sheet as required, the steel sheet is subjected to cold rolling once, or twice or more with intermediate annealing interposed therebetween to obtain a cold-rolled steel sheet having a final thickness.

During cold rolling, behaviors in deformation of the steel sheet in the final step of cold rolling (i.e., a single step itself when the cold rolling is performed once, or a final step when it is performed twice or more) affect the texture of the rolled steel sheet, and the resulting effect reflects upon the primary recrystallization texture and the secondary recrystallization orientation. From the viewpoint of proper control of the texture, it is preferable to progress uneven deformation in crystal grains during the final step of cold rolling. To that end, C of not less than 0.01 mass % is preferably contained in the steel sheet before the final step of cold rolling.

The cold rolling may be performed at the normal temperature, or may be replaced with warm rolling that is performed at temperature higher than the normal one, e.g., at around 250° C.

Further, instead of the above-described method, the rolling process may be performed, for example, such that the slab thickness is reduced and the hot rolling is omitted.

Then, the final cold-rolled steel sheet is subjected to primary-recrystallization continuous annealing as required. The primary-recrystallization continuous annealing is performed to form the primary recrystallization structure and surface that are optimum for secondary recrystallization developed in the first batch annealing. In practical, it is possible to omit that continuous annealing or perform annealing in the low temperature range, in which the primary recrystallization is not developed, before proceeding to the next step (first batch annealing). For stabilizing the magnetic characteristics at a high level, however, the primary recrystallization is preferably developed prior to the first batch annealing.

From the viewpoint of control of the primary recrystallization structure, the annealing temperature in the primary-recrystallization continuous annealing is preferably in the range of about 700 to 1050° C., and the annealing time is preferably in the range of about 1 second to 20 minutes. If the annealing temperature is lower than about 700° C. or the annealing time is shorter than about 1 second, the magnetic characteristics tend to deteriorate because the primary recrystallization and subsequent grain growth are insufficient and the secondary recrystallization are unsatisfactory. On the other hand, if the annealing temperature exceeds about 1050° C., the size of primary recrystallization grains would be coarse and the secondary recrystallization would be possibly unsatisfactory. Also, if the annealing time exceeds 20 minutes, the effect would be saturated and the economical efficiency would be deteriorated.

Incidentally, the annealing temperature in the primary-recrystallization continuous annealing means a maximum temperature of the steel sheet which is reached during the annealing. The term "annealing time" means the total time during which the temperature of the steel sheet is in the predetermined range (about 750 to 1050° C. in the above case).

An annealing atmosphere for the primary-recrystallization continuous annealing is preferably a low-oxidization atmosphere. Herein, the term "low-oxidization atmosphere" means (i) inert gas (such as nitrogen or argon) with a dew point not higher than 0° C., (ii) hydrogen with $P[H_2O]/P[H_2]$ of not more than 0.6, or (iii) a mixed atmosphere of (i) and (ii). If the cold-rolled steel sheet is annealed in a high-oxidization humid hydrogen atmosphere or an oxygen-containing atmosphere, nitriding and oxidization would occur during the batch annealing, and the crystal orientation of secondary recrystallization grains would be deteriorated, thus resulting in a risk that the magnetic characteristics would be deteriorated.

Assuming the atmosphere oxygen potential ($P[H_2O]/P[H_2]$) in the primary-recrystallization continuous annealing to be A, it is particularly preferable that the atmosphere satisfy $A \leqq 0.6$. If A exceeds about 0.6, alignment of the <001> direction of secondary recrystallization grains into the rolling direction would be slightly reduced.

Also, to form a satisfactory coating particularly after the first batch annealing, it is preferable that C remain in amount of about 0.003 to 0.03 mass % in the steel sheet before the first batch annealing.

The method of controlling the C content in the steel before the first batch annealing to be held in the above-mentioned range is preferably performed, for example, by adjusting the temperature and time of the annealing subsequent to the rollings (the annealing of the hot-rolled steel sheet, the intermediate annealing, and the primary-recrystallization continuous annealing), the oxidization and dew point of the atmosphere, etc. depending on the C content of the slab. To progress decarburization, for example, it is preferable that when a hydrogen gas alone or a mixed atmosphere of hydrogen and inert gas (such as nitrogen or argon) is used, $P[H_2O]/P[H_2]$ of the atmosphere be held in the range of 0.1 to 0.7, and when inert gas (such as nitrogen or argon) is used, the atmosphere have the dew point of 10 to 60° C.

Furthermore, preferably, the C content in the slab is held to be not more than 0.03 mass % to mitigate the burden of decarburization required until the first batch annealing, or to omit the decarburization itself.

Then, the first batch annealing is performed. The first batch annealing is intended to develop the secondary recrystallization. The first batch annealing is preferably performed under annealing conditions of the annealing temperature in the range of about 750 to 1250° C. and the annealing time in the range of 30 minutes to 500 hours.

If the annealing temperature is lower than about 750° C., the secondary recrystallization would be difficult to develop. If the annealing temperature exceeds about 1250° C., the effect would be saturated and the cost would be increased. A preferable upper limit of the annealing temperature is about 1100° C. Also, if the annealing time is shorter than about 30 minutes, the secondary recrystallization would be difficult to develop. If the annealing time exceeds about 500 hours, the effect would be saturated and the cost would be increased.

An area rate of the secondary recrystallization grains after the first batch annealing is preferably not less than about 10%. If the area rate is less than about 10%, the secondary recrystallization would be affected by the subsequent annealing and the magnetic characteristics would be possibly deteriorated. The area rate of the secondary recrystallization grains is measured by etching the surface of the steel sheet with, e.g., an aqueous solution of nitric acid.

Although it is not always required to apply an annealing separator before the first batch annealing, the annealing separator may be applied when there is a risk that fusion may occur between steel sheet layers.

After the first batch annealing, continuous annealing (called continuous annealing after the first batch annealing) is performed. This continuous annealing is intended to form the surface of the steel sheet (i.e., to form sub-scale) optimum for formation of a forsterite coating in second batch annealing.

As mentioned above, by causing C to remain before the first batch annealing, a steel sheet surface having highly satisfactory properties is formed. The reason is not yet fully clarified, but presumably resides in the fact that, in the present invention in which sub-scale is formed after development of the secondary recrystallization grains, the decarburization reaction and the sub-scale forming reaction take place in parallel, which contributes to stable formation of the sub-scale.

The annealing temperature in the continuous annealing after the first batch annealing is preferably in the range of about 750 to 1100° C. and the annealing time is preferably in the range of about 1 second to about 20 minutes. If the annealing temperature is lower than about 750° C. or the annealing time is shorter than about 1 second, oxidization of the steel sheet surface would be insufficient and the thickness of the formed forsterite coating would be reduced, thus resulting in deterioration of coating characteristics. On the other hand, if the annealing temperature exceeds about 1100° C., the amount of oxidization of the steel sheet surface would be excessive and the coating characteristics would be possibly deteriorated. If the annealing time exceeds about 20 minutes, the effect would be saturated and the cost efficiency would be deteriorated.

Note that, as with the primary-recrystallization continuous annealing before the first batch annealing, the annealing temperature in the continuous annealing after the first batch annealing means a maximum temperature of the steel sheet which is reached during the annealing, and the annealing time means a total time during which the temperature of the steel sheet is in the predetermined range.

Also, as with the primary-recrystallization continuous annealing, an annealing atmosphere for continuous annealing after the first batch annealing is preferably a low-oxidization humid hydrogen atmosphere or a dried hydrogen atmosphere.

Assuming the atmosphere oxygen potential ($P[H_2O]/P[H_2]$) in the continuous annealing after the first batch annealing to be B, it is particularly preferable that the atmosphere substantially satisfy $0.1 \leqq B \leqq 0.7$.

It is more preferable to substantially satisfy not only $A \leqq 0.6$ and $0.1 \leqq B \leqq 0.7$, but also $B-A \geqq 0$.

If B is less than about 0.1 or more than about 0.7, a part of the forsterite coating would be peeled off and the coating characteristics would possibly deteriorate. Further, if B−A is less than about 0, the formation of the forsterite coating would tend to be insufficient and the coating characteristics would possibly deteriorate.

As to the annealing atmosphere for continuous annealing after the first batch annealing, the atmosphere oxidization is desirably controlled so that the C content in the steel sheet can be reduced to about 0.005 mass % or below and preferably to about 0.003 mass % or below. More specifically, to prevent aging deterioration of the iron loss, it is desirable to reduce the C content in the product stage. In the second batch annealing described later, however, a difficulty occurs in performing decarburization because an annealing separator is applied. For that reason, the C content is preferably reduced so as to fall in the above-mentioned range during the continuous annealing between the two separate steps of batch annealing.

Reducing the C content in the steel sheet during that continuous annealing is also preferable in that the formation of sub-scale is stabilized by performing both the formation of sub-scale and the decarburization at the same time. The reason is not yet fully clarified, but presumably resides in that, by performing the formation of sub-scale parallel to the decarburization, the rate of progress of oxidization is properly controlled in a region from the steel sheet surface toward the inside in the direction of sheet thickness, and satisfactory lamellar sub-scale is formed.

A preferable atmosphere for the decarburization is selected as described above.

After the above-described continuous annealing, an annealing separator is coated over the steel sheet surface, and the second batch annealing (finishing annealing) is then performed.

Any of well-known various annealing separators can be suitably used in the present invention. Preferably, the annealing separator comprises magnesia as a main component and additives such as titania, strontium compounds, sulfides, chlorides and borides, which are added as required, and it is prepared in the form of an aqueous slurry and then coated. Herein, the expression "comprises magnesia as a main component" means that magnesia content is not less than about 70 weight % of the weight of solid component of the annealing separator.

Other examples of the annealing separator include silica (colloidal silica), alumina (calcia), etc., but the annealing separator usable in the present invention is not limited to the above-mentioned examples.

After applying the annealing separator, the second batch annealing (finishing annealing) is performed.

The second batch annealing is intended to form the forsterite coating. The second batch annealing is preferably performed under annealing conditions of the annealing temperature in the range of about 800 to 1300° C. and the annealing time in the range of about 1 to 1000 hours. If the annealing temperature is lower than about 800° C. or the annealing time is shorter than about 1 hour, the progress of the forsterite forming reaction tends to be insufficient and satisfactory coating characteristics tend to be difficult to obtain. On the other hand, if the annealing temperature exceeds 1300° C. or the annealing time exceeds 1000 hours, the effect would be saturated and the cost efficiency deteriorates. A more preferable lower limit of the annealing temperature is about 900° C., and an even more preferable lower limit thereof is about 1060° C.

Further, after the second batch annealing, an insulating coating is coated on the steel sheet surface and then baked. The type of the insulating coating is not limited to any particular one, and any of well-known insulating coatings is usable in the present invention. One preferable method involves applying a coating solution, which contains a phosphate, chromic acid and colloidal silica, and baking it at around 800° C., as disclosed in Japanese Unexamined Patent Application Publication Nos. 50-79442 and 48-39338, for example.

Additionally, flattening annealing can also be performed to correct the shape of the steel sheet. As an alternative, flattening annealing may be performed such that is serves also to bake the insulating coating.

Thus manufactured steel sheet has preferably a composition of C: about not more than about 0.005 mass %, Si: not more than about 4.5 mass % (preferably not less than about 1.0 mass %), Mn: about 0.03 to about 2.5 mass %, optionally at least any one of Sb: about 0.001 to about 0.2 mass %, Sn: about 0.001 to about 0.4 mass %, Bi: about 0.0005 to about 0.05 mass %, and Cu: about 0.01 to about 0.5 mass %, and the remainder being Fe and incidental elements or impurities (such as described before).

EXAMPLES

Example 1

A steel slab having a composition of C: 0.04 mass %, Si: 3.0 mass %, Mn: 0.08 mass %, Se: 200 ppm, Sb: 0.02 mass %, and the balance consisting of Fe and incidental impurities was heated to 1420° C. and then subjected to hot rolling to obtain a hot-rolled sheet with a thickness of 2.0 mm. Thereafter, the hot-rolled steel sheet was annealed at 1000° C. for 30 seconds. Then, the steel sheet was subjected to a first step of cold rolling to have a thickness of 0.60 mm, subjected to intermediate annealing at 900° C. for 30 seconds, and further subjected to a second step of cold rolling to obtain a cold-rolled steel sheet with a final thickness of 0.22 mm.

Subsequently, the primary-recrystallization continuous annealing was performed on the cold-rolled steel sheet under conditions of the annealing temperature and the annealing time, shown in Table 1, in a humid hydrogen-nitrogen atmosphere (volume proportional ratio of 50:50, dew point of 65° C.) with the atmosphere oxygen potential $P[H_2O]/P[H_2]$ of 0.65. Then, the first batch annealing was performed under conditions of 875° C. and 100 hours in a nitrogen atmosphere (dew point of −40° C.). Thereafter, the continuous annealing after the first batch annealing was performed under conditions of the annealing temperature and the annealing time, shown in Table 1, in a humid hydrogen-nitrogen atmosphere (volume proportional ratio of 50:50, dew point of 59° C.) with the atmosphere oxygen potential $P[H_2O]/P[H_2]$ of 0.45.

After applying an annealing separator having a composition of magnesia: 95 mass % and titania: 5 mass % to be coated over the steel sheet surface, the second batch annealing (finishing annealing) was performed under conditions of 1220° C. and 5 hours in a dried hydrogen atmosphere (dew point of −40° C.).

As one example of the conventional process, a similar final cold-rolled steel sheet with a thickness of 0.22 mm was subjected to decarburization annealing (primary-recrystallization continuous annealing) under conditions of 820° C. and 2 minutes in a humid hydrogen-nitrogen atmosphere (volume proportional ratio of 50:50, dew point of 62° C.) with $P[H_2O]/P[H_2]=0.55$. Then, after coating an annealing separator having a composition of magnesia: 90 mass % and titania: 10 mass %, finishing annealing was performed under conditions of 1200° C. and 10 hours in a dried hydrogen atmosphere (dew point of −30° C.).

A coating solution containing a phosphate, chromic acid and colloidal silica at a weight ratio of 3:1:3 was coated over the surface of the steel sheet obtained after the finishing annealing, and then baked at 800° C.

Then, magnetic characteristics and coating characteristics of the steel sheet were measured after performing the strain releasing annealing at 800° C. for 3 hours in a nitrogen atmosphere. The magnetic characteristics were evaluated based on a magnetic flux density $B_8$ resulting upon exciting at 800 A/m, and the coating characteristics were evaluated based on a minimum bending diameter at which there occurred no peel-off of the coating when each product sheet after the strain releasing annealing was wound over a cylindrical column.

Obtained results are shown in Table 1.

TABLE 1

| No. | Primary Recrystallization Continuous Annealing | | Continuous Annealing after First Batch Annealing | | Magnetic Characteristics | Minimum Bending Diameter of Bending Peel-Off Resistance after Strain Releasing | Remarks |
|---|---|---|---|---|---|---|---|
| | Annealing Temperature | Annealing Time | Annealing Temperature | Annealing Time | $B_8$ (T) | Annealing (mm) | |
| 1 | 700° C. | 1 min | 850° C. | 2 min | 1.92 | 30 | Inventive Example |
| 2 | 900° C. | 1 min | 850° C. | 2 min | 1.90 | 30 | Inventive Example |
| 3 | 1050° C. | 1 min | 850° C. | 2 min | 1.91 | 35 | Inventive Example |
| 4 | 850° C. | 1 sec | 850° C. | 2 min | 1.90 | 30 | Inventive Example |
| 5 | 850° C. | 20 min | 850° C. | 2 min | 1.91 | 35 | Inventive Example |
| 6 | 850° C. | 1 min | 750° C. | 2 min | 1.91 | 30 | Inventive Example |
| 7 | 850° C. | 1 min | 900° C. | 2 min | 1.92 | 30 | Inventive Example |
| 8 | 850° C. | 1 min | 1100° C. | 2 min | 1.91 | 35 | Inventive Example |
| 9 | 850° C. | 1 min | 750° C. | 1 sec | 1.90 | 30 | Inventive Example |
| 10 | 850° C. | 1 min | 850° C. | 20 min | 1.91 | 35 | Inventive Example |
| 11 | 650° C. | 1 min | 850° C. | 2 min | 1.65 | 30 | Comparative Example |
| 12 | 1100° C. | 1 min | 850° C. | 2 min | 1.75 | 30 | Comparative Example |
| 13 | 700° C. | 0.5 sec | 850° C. | 2 min | 1.82 | 35 | Comparative Example |
| 15 | 850° C. | 1 min | 700° C. | 2 min | 1.90 | 55 | Comparative Example |
| 16 | 850° C. | 1 min | 1150° C. | 2 min | 1.90 | 60 | Comparative Example |
| 17 | 850° C. | 1 min | 750° C. | 0.5 sec | 1.91 | 55 | Comparative Example |
| 18 | conventional process | | | | 1.88 | 45 | Conventional Example |

As seen from Table 1, by employing the steps of primary-recrystallization continuous annealing—first batch annealing (secondary recrystallization)—continuous annealing (surface control)—second batch annealing (coating formation), and properly controlling the annealing temperature and time preferably in each of the primary-recrystallization continuous annealing, the first batch annealing and the continuous annealing after the first batch annealing, the magnetic characteristics and the coating characteristics much superior to those of the product sheets of Conventional Example and Comparative Examples were obtained.

Example 2

A steel slab having a composition of C: 0.03 mass %, Si: 3.0 mass %, Mn: 0.10 mass %, Al: 130 ppm, N: 50 ppm, and the balance consisting of Fe and inevitable impurities was subjected to hot rolling to obtain a hot-rolled sheet with a thickness of 2.3 mm. Thereafter, the hot-rolled steel sheet was annealed at 1000° C. for 30 seconds and then subjected to cold rolling to obtain a cold-rolled steel sheet with a final thickness of 0.30 mm.

Subsequently, the primary-recrystallization continuous annealing was performed on the cold-rolled steel sheet under conditions of 920° C. and 30 seconds in a hydrogen-argon atmosphere (volume proportional ratio of 50:50, dew point of −40 to 65° C.) with various values of oxidization (oxygen potential) (A) shown in Table 2. Then, the first batch annealing was performed under conditions of 880° C. and 50 hours in a nitrogen atmosphere (dew point of −40° C.). Thereafter, the continuous annealing (i.e., the continuous annealing after the first batch annealing) was performed under conditions of 850° C. and 2 minutes in a humid hydrogen-argon atmosphere (volume proportional ratio of 50:50, dew point of 30 to 60° C.) with various values of oxidization (oxygen potential) (B) shown in Table 2.

After applying magnesia as an annealing separator to be coated over the steel sheet surface, the second batch annealing (finishing annealing) was performed under conditions of 1180° C. and 5 hours in a dried hydrogen atmosphere (dew point of −40° C.).

As one example of the conventional process, a final cold-rolled steel sheet with a thickness of 0.30 mm was subjected to decarburization annealing (primary-recrystallization continuous annealing) under conditions of 820° C. and 2 minutes in a humid hydrogen-nitrogen atmosphere (volume proportional ratio of 50:50, dew point of 59° C.) with $P[H_2O]/P[H_2]=0.45$. Then, after coating an annealing separator having a composition of magnesia: 95 mass % and titania: 5 mass %, finishing annealing was performed under conditions of 1180° C. and 5 hours in a dried hydrogen atmosphere (dew point of −40° C.).

A coating solution containing a phosphate, chromic acid and colloidal silica at a weight ratio of 2:1:1 was coated over the surface of the steel sheet obtained after the finishing annealing, and then baked at 800° C.

Then, magnetic characteristics and coating characteristics of the steel sheet were measured after performing the strain releasing annealing at 800° C. for 3 hours in a nitrogen atmosphere.

Obtained results are shown in Table 2.

TABLE 2

| No. | Atmosphere Oxygen Potential A after Primary Recrystallization Continuous Annealing | Atmosphere Oxygen Potential B after First Batch Annealing | B-A | Magnetic Characteristics $B_8$ (T) | Minimum Bending Diameter of Bending Peel-Off Resistance after Strain Releasing Annealing (mm) | Remarks |
|---|---|---|---|---|---|---|
| 1 | 0 | 0.7 | 0.7 | 1.93 | 25 | Inventive Example |
| 2 | 0.2 | 0.7 | 0.5 | 1.94 | 25 | Inventive Example |
| 3 | 0.5 | 0.7 | 0.2 | 1.93 | 25 | Inventive Example |
| 4 | 0.6 | 0.6 | 0 | 1.93 | 25 | Inventive Example |
| 5 | 0 | 0.4 | 0.4 | 1.93 | 25 | Inventive Example |
| 6 | 0.2 | 0.4 | 0.2 | 1.93 | 25 | Inventive Example |
| 7 | 0 | 0.1 | 0.1 | 1.94 | 25 | Inventive Example |
| 8 | 0.65 | 0.7 | 0.05 | 1.90 | 25 | Inventive Example |
| 9 | 0.4 | 0.35 | −0.05 | 1.92 | 35 | Inventive Example |
| 10 | 0.01 | 0.05 | 0.04 | 1.92 | 35 | Inventive Example |
| 11 | conventional process | | | 1.89 | 45 | Conventional Example |

As seen from Table 2, by controlling the atmosphere (oxygen potential of the atmosphere) for each of the primary-recrystallization continuous annealing and the continuous annealing after the first batch annealing, more superior magnetic characteristics and coating characteristics were obtained. Particularly, in a grain-oriented electrical steel sheet manufactured under conditions satisfying $A \leqq 0.6$, $0.1 \leqq B \leqq 0.7$ and $B-A \geqq 0$, the magnetic characteristics or the coating characteristics were further improved in comparison with those in the cases of not satisfying the above relationships.

Example 3

A steel slab having a composition of C: 0.05 mass %, Si: 3.0 mass %, Mn: 0.07 mass %, S: 0.007 mass %, Al: 0.027 mass %, N: 0.008 mass %, Sn: 0.05 mass %, and the balance consisting of Fe and inevitable impurities was heated to 1150° C. and then subjected to hot rolling to obtain a hot-rolled sheet with a thickness of 2.3 mm. Thereafter, the hot-rolled steel sheet was subjected to a first step of cold rolling to have a thickness of 1.8 mm, subjected to intermediate annealing at 1100° C. for 2 minutes, and further subjected to a second step of cold rolling to obtain a cold-rolled steel sheet with a final thickness of 0.23 mm.

Subsequently, the primary-recrystallization continuous annealing was performed on the final cold-rolled steel sheet under conditions of 830° C. and 120 seconds in a humid hydrogen-nitrogen atmosphere (volume proportional ratio of 65:35, dew point of 61° C.) with the atmosphere oxygen potential $P[H_2O]/P[H_2]$ of 0.40. Thereafter, an inhibitor was intensified by performing annealing in an ammonia atmosphere such that the nitrogen content was increased to 0.025 mass %. Then, the first batch annealing was performed under conditions of 1250° C. and 30 minutes in a hydrogen-nitrogen mixed atmosphere (volume proportional ratio of 65:35, dew point of −20° C.). Thereafter, the continuous annealing (i.e., the continuous annealing after the first batch annealing) was performed under conditions of 850° C. and 10 minutes in a humid hydrogen-nitrogen atmosphere (volume proportional ratio of 65:35, dew point of 65° C.) with the atmosphere oxygen potential $P[H_2O]/P[H_2]$ of 0.55.

After coating an annealing separator having a composition of magnesia: 98 mass %, magnesium sulfate: 1.5 mass % and magnesium chloride: 0.5 mass %, the second batch annealing (finishing annealing) was performed under conditions of 800° C. and 1000 hours in a dried hydrogen atmosphere (dew point of −20° C.).

A coating solution containing a phosphate, chromic acid and colloidal silica at a weight ratio of 3:1:2 was coated over the surface of the steel sheet obtained after the finishing annealing, and then baked at 800° C.

A product sheet of Conventional Example according to the conventional process was manufactured as follows.

A similar final cold-rolled steel sheet as that described above was subjected to continuous annealing (primary-recrystallization continuous annealing) under conditions of 830° C. and 120 seconds in a humid hydrogen-nitrogen atmosphere (volume proportional ratio of 65:35, dew point of 61° C.) with $P[H_2O]/P[H_2]=0.40$. Then, an inhibitor was intensified by performing annealing in an ammonia atmosphere such that the nitrogen content was increased to 0.025 mass %.

After coating an annealing separator having a composition of magnesia: 98 mass % and magnesium sulfate: 2 mass %, finishing annealing was performed under conditions of 1200° C. and 10 hours in a dried hydrogen atmosphere (dew point of −20° C.). A coating solution containing a phosphate, chromic acid and colloidal silica at a weight ratio of 3:1:2 was coated over the steel sheet surface, and then baked at 800° C.

Then, the product sheets thus obtained as Inventive Example and Conventional Example were measured for magnetic characteristics and coating characteristics after performing the strain releasing annealing at 800° C. for 3 hours in a nitrogen atmosphere.

As a result, Inventive Example had the magnetic characteristic $B_8$ of 1.94T, while Conventional Example had the magnetic characteristic $B_8$ of 1.92T. In other words, Inventive Example was superior in magnetic characteristics to Conventional Example.

As to the bending peel-off resistance after the strain releasing annealing, the minimum bending diameter was 25 mm in Inventive Example and 35 mm in Conventional Example. In other words, Inventive Example was also superior in coating characteristics to Conventional Example.

Example 4

A steel slab having a composition of C: 0.02 mass %, Si: 3.0 mass %, Mn: 0.15 mass %, S: 0.002 mass %, Al: 0.008 mass %, N: 0.003 mass %, Sb: 0.025 mass %, and the balance consisting of Fe and inevitable impurities was heated to 1200° C. and then subjected to hot rolling to obtain a hot-rolled sheet with a thickness of 2.3 mm. Thereafter, the hot-rolled steel sheet was subjected to a first step of cold rolling to have a thickness of 1.8 mm, subjected to intermediate annealing at 1100° C. for 2 minutes, and further subjected to a second step of cold rolling to obtain a cold-rolled steel sheet with a final thickness of 0.23 mm.

Subsequently, the primary-recrystallization continuous annealing was performed on the final cold-rolled steel sheet under conditions of 860° C. and 20 seconds in a humid hydrogen-nitrogen atmosphere (volume proportional ratio of 70:30, dew point of 62° C.) with the atmosphere oxygen potential $P[H_2O]/P[H_2]$ of 0.40. Then, the first batch annealing was performed under conditions of 750° C. and 500 hours in a hydrogen-nitrogen mixed atmosphere (volume proportional ratio of 10:90, dew point of −30° C.). Thereafter, the continuous annealing (i.e., the continuous annealing after the first batch annealing) was performed under conditions of 850° C. and 3 minutes in a humid hydrogen-nitrogen atmosphere (volume proportional ratio of 70:30, dew point of 66° C.) with the atmosphere oxygen potential $P[H_2O]/P[H_2]$ of 0.50.

After coating an annealing separator having a composition of magnesia: 98 mass % and strontium hydroxide: 2 mass %, the second batch annealing (finishing annealing) was performed under conditions of 1300° C. and 1 hour in a dried hydrogen atmosphere (dew point of −40° C.).

A coating solution containing a phosphate, chromic acid and colloidal silica at a weight ratio of 3:1:2 was coated over the surface of the steel sheet obtained after the finishing annealing, and then baked at 800° C.

A product sheet of Conventional Examples according to the conventional process was manufactured as follows.

A similar final cold-rolled steel sheet as that described above was subjected to continuous annealing (primary-recrystallization continuous annealing) under conditions of 860° C. and 20 seconds in a humid hydrogen-nitrogen atmosphere (volume proportional ratio of 70:30, dew point of 62° C.) with $P[H_2O]/P[H_2]=0.40$. After coating an annealing separator having a composition of magnesia: 98 mass % and strontium hydroxide: 2 mass %, finishing annealing was performed under conditions of 1200° C. and 10 hours in a dried hydrogen atmosphere (dew point of −30° C.). A coating solution containing a phosphate, chromic acid and colloidal silica at a weight ratio of 3:1:2 was coated over the steel sheet surface, and then baked at 800° C.

Then, the product sheets thus obtained as Inventive Example and Conventional Example were measured for magnetic characteristics and coating characteristics after performing the strain releasing annealing at 800° C. for 3 hours in a nitrogen atmosphere.

As a result, Inventive Example had the magnetic characteristic $B_8$ of 1.92T, while Conventional Example had the magnetic characteristic $B_8$ of 1.88T. In other words, Inventive Example was superior in magnetic characteristics to Conventional Example.

As to the bending peel-off resistance after the strain releasing annealing, the minimum bending diameter was 25 mm in Inventive Example and 45 mm in Conventional Example. In other words, Inventive Example was also superior in coating characteristics to Conventional Example.

Example 5

A steel slab having a composition of C: 0.05 mass %, Si: 3.0 mass %, Mn: 0.10 mass %, Al: 130 ppm, and the balance consisting of Fe and inevitable impurities was heated to 1150° C. and then subjected to hot rolling to obtain a hot-rolled sheet with a thickness of 2.0 mm. Thereafter, the hot-rolled steel sheet was annealed at 1000° C. for 30 seconds and then subjected to cold rolling to obtain a cold-rolled steel sheet with a final thickness of 0.30 mm.

The cold-rolled steel sheet thus obtained was divided into 11 pieces. Of the divided 11 pieces, Nos. 1 to 8 steel sheets were subjected successively to the primary-recrystallization continuous annealing—the first batch annealing—the continuous annealing after the first batch annealing—coating of an annealing separator—the second batch annealing according to the present invention. In that process, conditions for both the steps of continuous annealing before and after the first batch annealing were variously changed as shown in Table 3. The atmosphere used in the primary-recrystallization continuous annealing was a hydrogen-nitrogen atmosphere (volume proportional ratio of 40:60, dew point of −40 to 60° C.), and the atmosphere used in the continuous annealing after the first batch annealing was a humid hydrogen-nitrogen atmosphere (volume proportional ratio of 40:60, dew point of 40 to 62° C.).

The first batch annealing was performed under conditions of 830° C. and 50 hours in a nitrogen atmosphere (dew point of −40° C.). Also, the second batch annealing was performed under conditions of 1180° C. and 5 hours in a dried hydrogen atmosphere (dew point of −30° C.). Further, an annealing separator containing magnesia: 95 mass % and titania: 5 mass % was employed.

Nos. 9 to 11 steel sheets were subjected as Conventional Examples to the conventional process. More specifically, those cold-rolled steel sheets each having a thickness of 0.30 mm were subjected to decarburization annealing (primary-recrystallization continuous annealing) under three different conditions shown in Table 3. Then, after coating an annealing separator (magnesia: 95 mass % and titania: 5 mass %), finishing annealing was performed under conditions of 1180° C. and 5 hours in a dried hydrogen atmosphere (dew point of −30° C.).

Subsequently, a coating solution containing a phosphate, chromic acid and colloidal silica at a weight ratio of 3:1:2 was coated over each of all the No. 1 to 11 steel sheets, and then baked at 800° C. Product sheets of Inventive Examples and Conventional Examples were thereby obtained.

Then, magnetic characteristics and coating characteristics of each product sheet were measured after performing the strain releasing annealing at 800° C. for 3 hours in a nitrogen atmosphere. Also, changes of the C content in each steel sheet during the manufacturing process were examined.

The magnetic characteristics were evaluated based on a magnetic flux density $B_8$ resulting upon exciting at 800 A/m, and the coating characteristics were evaluated based on a minimum bending diameter at which there occurred no peel-off of the coating when each product sheet after the strain releasing annealing was wound over a cylindrical column.

Obtained results are shown in Table 3.

TABLE 3

| No. | Primary Recrystallization Continuous Annealing Conditions: Temperature (° C.) | Time (min) | $P[H_2O]/P[H_2]$ | Conditions of Continuous Annealing after First Batch Annealing: Temperature (° C.) | Time (min) | $P[H_2O]/P[H_2]$ | C Content (mass %): Before Final Cold Rolling | Before First Batch Annealing | Product Sheet | $B_8$ (T) | Minimum Bending Diameter of Bending Peel-Off Resistance (mm) | Remarks |
|---|---|---|---|---|---|---|---|---|---|---|---|---|
| 1 | 800 | 1 | 0.3 | 850 | 2 | 0.5 | 0.040 | 0.015 | 0.002 | 1.93 | 25 | Inventive Example |
| 2 | 825 | 1 | 0.2 | 880 | 2 | 0.6 | 0.041 | 0.023 | 0.002 | 1.94 | 20 | Inventive Example |
| 3 | 825 | 1 | 0.5 | 850 | 2 | 0.5 | 0.041 | 0.007 | 0.001 | 1.93 | 20 | Inventive Example |
| 4 | 825 | 1 | 0.6 | 850 | 2 | 0.5 | 0.040 | 0.005 | 0.001 | 1.94 | 25 | Inventive Example |
| 5 | 700 | 1 | 0.2 | 880 | 2 | 0.6 | 0.039 | 0.034 | 0.004 | 1.90 | 30 | Inventive Example |
| 6 | 840 | 1 | 0 | 850 | 2 | 0.7 | 0.041 | 0.038 | 0.003 | 1.89 | 30 | Inventive Example |
| 7 | 800 | 1 | 0.3 | 850 | 1 | 0.2 | 0.040 | 0.015 | 0.007 | 1.92 | 50 | Inventive Example |
| 8 | 840 | 2 | 0.6 | 850 | 2 | 0.5 | 0.041 | 0.001 | 0.001 | 1.88 | 35 | Inventive Example |
| | Decarburization Annealing Conditions: Temperature (° C.) | Time (min) | $P[H_2O]/P[H_2]$ | | | | — | | — | — | — | — |
| 9 | 825 | 1 | 0.2 | | | | 0.041 | 0.021 | 0.020 | 1.89 | 60 | Conventional Example |
| 10 | 850 | 2 | 0.6 | | | | 0.040 | 0.002 | 0.002 | 1.83 | 30 | Conventional Example |
| 11 | 875 | 2 | 0.5 | | | | 0.040 | 0.003 | 0.002 | 1.87 | 50 | Conventional Example |

As seen from Table 3, when processing the steel sheet through the manufacturing process according to the present invention (i.e., Nos. 1 to 8), any of those Inventive Examples was superior in both magnetic flux density and coating adhesion to Conventional Examples. In particular, a grain-oriented electrical steel sheet being superior in both magnetic flux density and coating adhesion was obtained in Nos. 1 to 4 Inventive Examples in which the C content was controlled more preferably, controlling the C content in the steel before the first batch annealing to be held in the range of 0.003 to 0.03 mass %, and reducing the C content in the product sheet to be not more than 0.005 mass %.

Example 6

A steel slab having a composition of C: 0.04 mass %, Si: 3.0 mass %, Mn: 0.08 mass %, Se: 200 ppm, and the balance consisting of Fe and inevitable impurities was heated to 1420° C. and then subjected to hot rolling to obtain a hot-rolled sheet with a thickness of 2.0 mm. Thereafter, the hot-rolled steel sheet was annealed at 1000° C. for 30 seconds. Then, the steel sheet was subjected to a first step of cold rolling to have a thickness of 0.60 mm, subjected to intermediate annealing, and further subjected to a second step of cold rolling to obtain a cold-rolled steel sheet with a final thickness of 0.23 mm.

The cold-rolled steel sheet thus obtained was divided into 11 pieces. Of the divided 11 pieces, Nos. 1 to 8 steel sheets were subjected successively to the primary-recrystallization continuous annealing (omitted for No. 7)—the first batch annealing—the continuous annealing after the first batch annealing—coating of an annealing separator—the second batch annealing according to the present invention. In that process, conditions for the intermediate annealing and both the steps of continuous annealing before and after the first batch annealing were variously changed as shown in Table 4. The atmosphere used in the intermediate annealing was a hydrogen-nitrogen atmosphere (volume proportional ratio of 50:50, dew point of −40 to 60° C.). The atmosphere used in the primary-recrystallization continuous annealing was a hydrogen-nitrogen atmosphere (volume proportional ratio of 50:50, dew point of 20 to 65° C.), and the atmosphere used in the continuous annealing after the first batch annealing was a hydrogen-nitrogen atmosphere (volume proportional ratio of 50:50, dew point of less than to 60° C.).

The first batch annealing was performed under conditions of 875° C. and 100 hours in a nitrogen atmosphere (dew point of −40° C.). Also, the second batch annealing was performed under conditions of 1220° C. and 5 hours in a dried hydrogen atmosphere (dew point of −30° C.). Further, an annealing separator containing magnesia: 90 mass % and titania: 10 mass % was employed.

Nos. 9 to 11 steel sheets were subjected as Conventional Examples to the conventional process. More specifically, those cold-rolled steel sheets each having a thickness of 0.23 mm were subjected to decarburization annealing under three different conditions shown in Table 4. Then, after coating an annealing separator (magnesia: 90 mass % and titania: 10 mass %), finishing annealing was performed under conditions of 1200° C. and 10 hours in a dried hydrogen atmosphere (dew point of −30° C.).

Subsequently, a coating solution containing a phosphate, chromic acid and colloidal silica at a weight ratio of 3:1:3 was coated over each of all the No. 1 to 11 steel sheets, and then baked at 800° C. Product sheets of Inventive Examples and Conventional Examples were thereby obtained.

Then, magnetic characteristics and coating characteristics of each product sheet were measured after performing the strain releasing annealing at 800° C. for 3 hours in a nitrogen atmosphere. Also, changes of the C content in each steel sheet during the manufacturing process were examined.

Obtained results are shown in Table 5.

TABLE 4

| No. | Intermediate Annealing Conditions Temperature (° C.) | Time | $P[H_2O]/P[H_2]$ | Primary Recrystallization Continuous Annealing Conditions Temperature (° C.) | Time | $P[H_2O]/P[H_2]$ | Conditions of Annealing after First Batch Annealing Temperature (° C.) | Time | $P[H_2O]/P[H_2]$ | Remarks |
|---|---|---|---|---|---|---|---|---|---|---|
| 1 | 900 | 30 sec | 0.2 | 900 | 1 min | 0.3 | 900 | 2 min | 0.4 | Inventive Example |
| 2 | 900 | 30 sec | 0.2 | 850 | 2 min | 0.2 | 850 | 2 min | 0.5 | Inventive Example |
| 3 | 900 | 30 sec | 0.2 | 850 | 2 min | 0.5 | 850 | 2 min | 0.2 | Inventive Example |
| 4 | 900 | 30 sec | 0 | 820 | 1 min | 0 | 900 | 2 min | 0.7 | Inventive Example |
| 5 | 1000 | 1 min | 0.1 | 900 | 30 sec | 0.3 | 880 | 2 min | 0.4 | Inventive Example |
| 6 | 1000 | 5 min | 0.5 | 900 | 30 sec | 0 | 850 | 2 min | 0.5 | Inventive Example |
| 7 | 1000 | 1 min | 0.5 | | omitted | | 900 | 2 min | 0.6 | Inventive Example |
| 8 | 1000 | 1 min | 0.1 | 850 | 2 min | 0.5 | 850 | 2 min | 0.2 | Inventive Example |
| | | | | Decarburization Annealing Conditions | | | | | | |
| | | | | Temperature (° C.) | Time (min) | $P[H_2O]/P[H_2]$ | | | | |
| 9 | 1000 | 1 min | 0.1 | 850 | 2 | 0.3 | | | | Conventional Example |
| 10 | 1000 | 1 min | 0.1 | 850 | 2 | 0.5 | | | | Conventional Example |
| 11 | 1000 | 1 min | 0.1 | 850 | 2 | 0.7 | | | | Conventional Example |

TABLE 5

| No. | C Content (mass %) Before Final Cold Rolling | Before First Batch Annealing | Product Sheet | $B_8$ (T) | Minimum Bending Diameter of Bending Peel-Off Resistance (mm) | Remarks |
|---|---|---|---|---|---|---|
| 1 | 0.030 | 0.015 | 0.002 | 1.93 | 30 | Inventive Example |
| 2 | 0.031 | 0.013 | 0.001 | 1.94 | 20 | Inventive Example |
| 3 | 0.031 | 0.002 | 0.002 | 1.86 | 35 | Inventive Example |
| 4 | 0.037 | 0.033 | 0.004 | 1.88 | 30 | Inventive Example |
| 5 | 0.034 | 0.020 | 0.003 | 1.95 | 25 | Inventive Example |
| 6 | 0.006 | 0.006 | 0.001 | 1.90 | 30 | Inventive Example |
| 7 | 0.018 | 0.018 | 0.002 | 1.90 | 30 | Inventive Example |
| 8 | 0.034 | 0.002 | 0.001 | 1.86 | 35 | Inventive Example |
| 9 | 0.036 | 0.006 | 0.006 | 1.88 | 70 | Conventional Example |
| 10 | 0.035 | 0.003 | 0.002 | 1.85 | 50 | Conventional Example |
| 11 | 0.035 | 0.001 | 0.001 | 1.82 | 30 | Conventional Example |

As seen from Table 5, Inventive Examples (Nos. 1 to 8) were all superior in both magnetic flux density and coating adhesion to Conventional Examples (Nos. 9 to 11) in which significant deterioration in magnetic flux density or coating adhesion was confirmed.

Particularly, when processing the steel sheet through the manufacturing process according to the present invention, controlling the C content in the steel before the first batch annealing to be held in the range of 0.003 to 0.03 mass %, and reducing the C content in the product sheet to be not more than 0.005 mass % (i.e., Nos. 1, 2 and 5), any of those Inventive Examples provided a grain-oriented electrical steel sheet superior in both magnetic flux density and coating adhesion to Conventional Examples. Also, in other Inventive Examples, i.e., Nos. 3, 4 and 8 in which the C content was not within the above-predetermined ranges, No. 6 in which the C content before the final cold rolling was lower than the predetermined range, and No. 7 in which the primary-recrystallization continuous annealing was omitted, any example succeeded in obtaining both of superior magnetic flux density and superior coating adhesion to Conventional Examples although achieved values were inferior to those in Nos. 1, 2 and 5.

Example 7

Steel slabs having compositions of:

(1) C: 0.04 mass %, Si: 4.2 mass %, Mn: 0.08 mass %, Sb: 0.02 mass %, and Bi: 0.01 mass %;

(2) C: 0.04 mass %, Si: 3.0 mass %, Mn: 1.5 mass %, Se: 180 ppm, and Sb: 0.02 mass %;

(3) C: 0.04 mass %, Si: 3.0 mass %, Mn: 0.06 mass %, Cu: 0.2 mass %, S: 0.02 mass %, and Sb: 0.01 mass %; and (4) C: 0.02 mass %, Si: 3.0 mass %, Mn: 0.08 mass %, Al: 70 ppm, and each of S, Se, N: not more than 30 ppm, in addition to the balance consisting of Fe and inevitable impurities, were each heated to 1420° C. (1150° C. in (4)) and then subjected to hot rolling to obtain a hot-rolled sheet with a thickness of 2.0 mm. Thereafter, the hot-rolled steel sheet was annealed at 1000° C. for 30 seconds. Then, the steel sheet was subjected to a first step of cold rolling to have a thickness of 0.60 mm, subjected to intermediate annealing at 900° C. for 30 seconds, and further subjected to a second step of cold rolling to obtain a cold-rolled steel sheet with a final thickness of 0.22 mm.

Subsequently, the primary-recrystallization continuous annealing was performed on each cold-rolled steel sheet under conditions of the annealing temperature of 850° C. and the annealing time of 1 minute in a nitrogen atmosphere with the dew point of −10° C. Then, the first batch annealing was performed under conditions of 875° C. and 100 hours in a nitrogen atmosphere (dew point of −30° C.). Thereafter, the continuous annealing after the first batch annealing was performed under conditions of the annealing temperature of 850° C. and the annealing time of 2 minutes in a humid hydrogen-nitrogen atmosphere (volume proportional ratio of 60:40, dew point of 62° C.) with the atmosphere oxygen potential $P[H_2O]/P[H_2]$ of 0.45.

After coating an annealing separator having a composition of magnesia: 95 mass % and titania: 5 mass %, the second batch annealing (finishing annealing) was performed under conditions of 1220° C. and 5 hours in a dried hydrogen atmosphere (dew point of −30° C.).

Product sheets of Conventional Examples according to the conventional process were manufactured as follows. Similar final cold-rolled steel sheets with a thickness of 0.22 mm as those described above were each subjected to decarburization annealing (primary-recrystallization continuous annealing) under conditions of 820° C. and 2 minutes in a humid hydrogen-nitrogen atmosphere (volume proportional ratio of 50:50, dew point of 62° C.) with $P[H_2O]/P[H_2]=0.55$. After coating an annealing separator having a composition of magnesia: 90 mass % and titania: 10 mass %, finishing annealing was performed under conditions of 1200° C. and 10 hours in a dried hydrogen atmosphere (dew point of −10° C.). The product sheets thus obtained are denoted by (1)' to (4)'.

A coating solution containing a phosphate, chromic acid and colloidal silica at a weight ratio of 3:1:3 was coated over the surface of each steel sheet obtained after the finishing annealing, and then baked at 800° C.

Then, the product sheets thus obtained as Inventive Examples and Conventional Examples were measured for magnetic characteristics and coating characteristics after performing the strain releasing annealing at 800° C. for 3 hours in a nitrogen atmosphere. The magnetic characteristics were evaluated based on a magnetic flux density $B_8$ resulting upon exciting at 800 A/m, and the coating characteristics were evaluated based on a minimum bending diameter at which there occurred no peel-off of the coating when each product sheet after the strain releasing annealing was wound over a cylindrical column.

Obtained results are given below. Values of $B_8$(T) were (1): 1.95, (1)': 1.93, (2): 1.92, (2)': 1.87, (3): 1.90, (3)': 1.85, (4): 1.93, (4)': 1.85, and values of the minimum bending radius (mm) were (1): 25, (1)': 40, (2): 20, (2)': 45, (3): 25, (3)': 45, (4): 20, (4)': 50.

As will be understood from the above description, by employing the steps of primary-recrystallization continuous annealing—first batch annealing (secondary recrystallization)—continuous annealing (surface control)—second batch annealing (formation of forsterite coating), a grain-oriented electrical steel sheet much superior in both magnetic characteristics and coating characteristics to those of conventional product sheets could be obtained.

In Examples 1 to 7, the content of Se, S, Al and N in the product steel sheet had been reduced to the amount of impurity level (less than 50 ppm).

Thus, according to the present invention, a grain-oriented electrical steel sheet having both of superior magnetic characteristics and superior coating characteristics can be obtained by dividing finishing annealing, in which secondary recrystallization and formation of a forsterite coating were performed at the same time, into two steps of batch annealing with continuous annealing interposed therebetween, and performing the secondary recrystallization and the formation of the forsterite coating in the two steps of batch annealing separately.

In preferable condition, a grain-oriented electrical steel sheet manufactured by this invention having a coating comprising forsterite (preferably, substantially consisting of forsterite) has $B_8$ of about 1.92T or more, and minimum bending diameter of about 25 mm or less.

What is claimed is:

1. A method of manufacturing a grain-oriented electrical steel sheet, comprising the steps of:

rolling a steel slab containing Si to obtain a steel sheet;

performing first batch annealing on said steel sheet;

performing continuous annealing on said sheet after said first batch annealing;

applying an annealing separator; and then performing second batch annealing on said sheet.

2. A method according to claim 1, wherein said steel slab contains Si in an amount of not more than about 4.5 mass % and C of about 0.01 to 0.1 mass %.

3. A method according to claim 1, wherein after said rolling step, said steel sheet is subjected to primary-recrystallization continuous annealing before said first batch annealing.

4. A method according to claim 3, wherein said primary-recrystallization continuous annealing is performed under conditions of annealing temperature of not lower than about 700° C., but not higher than about 1050° C. and an annealing time of not shorter than about 1 second, but not longer than about 20 minutes.

5. A method according to claim 3, wherein the atmosphere oxygen potential $P[H_2O]/P[H_2]$ in said primary-recrystallization continuous annealing is A and the atmosphere oxygen potential $P[H_2O]/P[H_2]$ in said continuous annealing after the first batch annealing is B, each step of said continuous annealing is performed under conditions substantially satisfying:

$$A \leqq 0.6,\ 0.1 \leqq B \leqq 0.7 \text{ and } B-A \geqq 0.$$

6. A method according to claim 1, wherein said first batch annealing is performed under conditions of annealing temperature of not lower than about 750° C., but not higher than about 1250° C. and an annealing time of not shorter than about 30 minutes, but not longer than about 500 hours.

7. A method according to claim 1, wherein said continuous annealing after said first batch annealing is performed under conditions of annealing temperature of not lower than about 750° C., but not higher than about 1100° C. and annealing time of not shorter than about 1 second, but not longer than about 20 minutes.

8. A method according to claim 1, wherein said rolling comprises hot rolling and cold rolling, and said steel sheet is obtained by the steps of:

hot-rolling said slab to make a hot-rolled sheet;

annealing said hot-rolled sheet as required; and performing cold rolling once, or twice or more with intermediate annealing interposed between cold rollings.

9. A method according to claim 8, wherein the C content in said steel sheet before the last of said cold rollings is controlled to be not less than about 0.01 mass %.

10. A method according to claim 1, wherein the C content in said steel sheet before said first batch annealing is controlled to be held in the range of not less than about 0.003 mass %, but not more than about 0.03 mass %.

11. A method according to claim 1, wherein the C content in said steel sheet after said second batch annealing is controlled to be not more than about 0.005 mass %.

12. A method according to claim 1, wherein said annealing separator is primarily composed of magnesia and said steel sheet after said second batch annealing has a forsterite coating.

13. A method of manufacturing a grain-oriented electrical steel sheet which is superior in both magnetic characteristics and coating characteristics, said method comprising the steps of:

hot-rolling a steel slab containing silicon to obtain a hot-rolled steel sheet;

annealing said hot-rolled steel sheet as required;

performing cold rolling once, or twice or more with intermediate annealing interposed therebetween to obtain a final sheet thickness;

performing primary-recrystallization continuous annealing under conditions of annealing temperature of not lower than about 700° C., but not higher than about 1050° C. and an annealing time of not shorter than about 1 second, but not longer than about 20 minutes;

performing first batch annealing under conditions of annealing temperature of not lower than about 750° C., but not higher than about 1250° C. and an annealing time of not shorter than about 30 minutes, but not longer than about 500 hours;

performing continuous annealing after said first batch annealing under conditions of annealing temperature of not lower than about 750° C., but not higher than about 1100° C. and an annealing time of not shorter than about 1 second, but not longer than about 20 minutes;

applying an annealing separator; and then performing second batch annealing to said sheet.

14. A method of manufacturing a grain-oriented electrical steel sheet having superior magnetic characteristics and coating characteristics, said method comprising the steps of:

hot-rolling a steel slab containing Si of not more than about 4.5 mass % and C of about 0.01 to about 0.1 mass % to obtain a hot-rolled steel sheet;

annealing said hot-rolled steel sheet as required;

performing cold rolling once, or twice or more with intermediate annealing interposed therebetween to obtain a final sheet thickness; and performing two steps of batch annealing with continuous annealing interposed therebetween, said method further comprising the steps of:

(1) controlling the C content in said steel sheet before said first batch annealing in the range of not less than about 0.003 mass %, but not more than about 0.03 mass %;

(2) applying an annealing separator to surfaces of the steel sheet before said second batch annealing; and (3) reducing the C content in said steel sheet after said second batch annealing to not more than about 0.005 mass %.

* * * * *